US011488509B2

(12) United States Patent
Song et al.

(10) Patent No.: US 11,488,509 B2
(45) Date of Patent: Nov. 1, 2022

(54) DISPLAY APPARATUS

(71) Applicant: Samsung Display Co., Ltd., Yongin-Si (KR)

(72) Inventors: Junyong Song, Hwaseong-si (KR); Chaehee Park, Suwon-si (KR); Sanghyun Heo, Hwaseong-si (KR); Bonghyun You, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/502,552

(22) Filed: Oct. 15, 2021

(65) Prior Publication Data

US 2022/0122511 A1 Apr. 21, 2022

(30) Foreign Application Priority Data

Oct. 19, 2020 (KR) ..... 10-2020-0135527

(51) Int. Cl.
*G09G 3/20* (2006.01)

(52) U.S. Cl.
CPC ..... *G09G 3/20* (2013.01); *G09G 2300/0809* (2013.01); *G09G 2310/0289* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 7,190,337 | B2 | 3/2007 | Miller, IV et al. | |
| 9,691,791 | B2 * | 6/2017 | Jeon | G09G 3/20 |
| 2014/0375922 | A1 * | 12/2014 | Park | G02F 1/136286 349/46 |
| 2016/0203753 | A1 * | 7/2016 | Hwang | G09G 3/2092 345/212 |
| 2017/0047016 | A1 * | 2/2017 | Son | G09G 3/3233 |
| 2017/0061837 | A1 * | 3/2017 | Tang | G09G 3/20 |

FOREIGN PATENT DOCUMENTS

| | | | |
|---|---|---|---|
| KR | 1020130101330 | A | 9/2013 |
| KR | 1020160041133 | A | 4/2016 |
| KR | 1020160047646 | A | 5/2016 |
| KR | 1020160076118 | A | 6/2016 |
| KR | 1020170019021 | A | 2/2017 |
| KR | 1020170126550 | A | 11/2017 |

* cited by examiner

*Primary Examiner* — Christopher J Kohlman
(74) *Attorney, Agent, or Firm* — Cantor Colburn LLP

(57) ABSTRACT

A display apparatus includes an integral integrated circuit and a display panel. The integral integrated circuit includes a gate channel which outputs a gate primitive signal and a data channel which outputs a data voltage. The display panel includes a level shifter which amplifies the gate primitive signal to generate a gate signal. The display panel is configured to display an image based on the gate signal and the data voltage. The display panel includes a first gate line extending in a first direction and a second gate line extending in a second direction. The second direction is different from the first direction. The second gate line is connected to the first gate line. The level shifter is connected to the second gate line.

20 Claims, 15 Drawing Sheets

DISPLAY APPARATUS

This application claims priority to Korean Patent Application No. 10-2020-0135527, filed on Oct. 19, 2020, and all the benefits accruing therefrom under 35 U.S.C. § 119, the content of which in its entirety is herein incorporated by reference.

BACKGROUND

1. Field

Embodiments of the present inventive concept relate to a display apparatus. More particularly, embodiments of the present inventive concept relate to a display apparatus including an integral integrated circuit including a gate driver and a data driver to reduce a bezel width.

2. Description of the Related Art

Generally, a display apparatus includes a display panel and a display panel driver. The display panel includes a gate line and a data line. The display panel driver includes a driving controller, a gate driver and a data driver.

Generally, the gate driver is disposed at a side portion of the display panel and the gate line extends in a horizontal direction in the display panel. The data driver is disposed at an upper portion or a lower portion of the display panel, and the data line extends in a vertical direction in the display panel.

Due to the gate driver, a bezel width of the side portion of the display panel may increase. In addition, the gate driver and the data driver are independently manufactured and bonded so that a manufacturing cost of the display apparatus may increase.

SUMMARY

Embodiments of the present inventive concept provide a display apparatus reducing a bezel width, forming a level shifter of a gate signal on a display panel or a flexible circuit substrate to overcome design constraints (i.e., the integral integrated circuit IIC cannot be located on the bezel area) in a structure having the reduced bezel width and generating the gate signal by a decoding method to reduce a power consumption.

In an embodiment of a display apparatus according to the present inventive concept, the display apparatus includes an integral integrated circuit and a display panel. The integral integrated circuit includes a gate channel which outputs a gate primitive signal and a data channel which outputs a data voltage. The display panel includes a level shifter which amplifies the gate primitive signal to generate a gate signal. The display panel is configured to display an image based on the gate signal and the data voltage. The display panel includes a first gate line extending in a first direction and a second gate line extending in a second direction. The second direction is different from the first direction, and the second gate line is connected to the first gate line. The level shifter is connected to the second gate line.

In an embodiment, the display panel may further include a data line extending in the second direction.

In an embodiment, the gate channel may be provided in plurality, and the integral integrated circuit may further include a decoder connected to the plurality of gate channels and which outputs the gate primitive signal to one of the gate channels.

In an embodiment, the display panel may further include a data line extending in the second direction and a sensing line extending in the second direction. The integral integrated circuit may further include a readout channel which receives a sensing signal from the sensing line.

In an embodiment, the integral integrated circuit may include a repeating channel group. The repeating channel group may include the data channel, the gate channel and the readout channel.

In an embodiment, the repeating channel group may include a first data channel, a first gate channel, a second data channel, a first readout channel and a third data channel which are sequentially disposed.

In an embodiment, when a pixel of the display panel includes an N-type transistor, the level shifter may include an N-type transistor.

In an embodiment, the display panel may include a first level shifter, a second level shifter, a third level shifter and a fourth level shifter which are sequentially disposed. The first level shifter and the third level shifter may be connected to a first clock line. The second level shifter and the fourth level shifter may be connected to a second clock line.

In an embodiment, the first level shifter may include a first transistor including a control electrode which receives the gate primitive signal, an input electrode which receives the gate primitive signal and an output electrode connected to a first node, a second transistor including a control electrode connected to the first node, an input electrode which receives a first gate power voltage and an output electrode connected to an output node, a third transistor including a control electrode connected to the first clock line, an input electrode which receives the first gate power voltage and an output electrode connected to a second node, a fourth transistor including a control electrode connected to the output node, an input electrode connected to the second node and an output electrode which receives a second gate power voltage, a fifth transistor including a control electrode connected to the second node, an input electrode connected to the output node and an output electrode which receives the second gate power voltage and a capacitor including a first electrode connected to the first node and a second electrode connected to the output node.

In an embodiment, the level shifter may include a first transistor including a control electrode which receives the gate primitive signal, an input electrode which receives the gate primitive signal and an output electrode connected to a first node, a second transistor including a control electrode connected to the first node, an input electrode which receives a first gate power voltage and an output electrode connected to an output node, a third transistor including a control electrode which receives a gate off signal, an input electrode connected to the output node and an output electrode which receives a second gate power voltage and a capacitor including a first electrode connected to the first node and a second electrode connected to the output node.

In an embodiment, the level shifter may be provided in plurality, an n-th level shifter may be configured to receive an n-th gate primitive signal from an n-th gate channel, to receive an n+1-th gate signal from an n+1-th level shifter and to output an n-th gate signal. n is a positive integer.

In an embodiment, the n-th level shifter may include a first transistor including a control electrode which receives the n-th gate primitive signal, an input electrode which receives the n-th gate primitive signal and an output electrode connected to a first node, a second transistor including a control electrode connected to the first node, an input electrode which receives a first gate power voltage and an output electrode connected to an output node, a third transistor including a control electrode which receives the n+1-th gate signal, an input electrode connected to the output node and an output electrode which receives a second gate power voltage and a capacitor including a first electrode connected to the first node and a second electrode connected to the output node.

In an embodiment, when a pixel of the display panel includes an N-type transistor and a P-type transistor, the level shifter may include an N-type transistor and a P-type transistor.

In an embodiment, the level shifter may include a first transistor including a control electrode which receives the gate primitive signal, an input electrode which receives a first gate power voltage and an output electrode connected to a first node, a second transistor including a control electrode which receives the gate primitive signal, an input electrode connected to the first node and an output electrode which receives a second gate power voltage, a third transistor including a control electrode connected to the first node, an input electrode which receives the first gate power voltage and an output electrode connected to an output node and a fourth transistor including a control electrode connected to the first node, an input electrode connected to the output node and an output electrode which receives the second gate power voltage.

In an embodiment, the display panel may further include contact points connecting the first gate lines and the second gate lines. The contact points may form an atypical random pattern.

In an embodiment of a display apparatus according to the present inventive concept, the display apparatus includes an integral integrated circuit including a gate channel which outputs a gate primitive signal and a data channel which outputs a data voltage, a flexible circuit substrate including a level shifter which amplifies the gate primitive signal to generate a gate signal, and a display panel connected to the flexible circuit substrate and which displays an image based on the gate signal and the data voltage. The integral integrated circuit is disposed on the flexible circuit substrate. The display panel includes a first gate line extending in a first direction and a second gate line extending in a second direction. The second direction is different from the first direction, and the second gate line is connected to the first gate line. The level shifter is connected to the second gate line.

In an embodiment, the level shifter may include a first transistor including a control electrode which receives a first gate power voltage, an input electrode which receives the first gate power voltage and an output electrode connected to a first node, a second transistor including a control electrode connected to the first node, an input electrode which receives the first gate power voltage and an output electrode connected to an output node, a third transistor including a control electrode which receives the gate primitive signal, an input electrode connected to the output node and an output electrode which receives a second gate power voltage and a capacitor including a first electrode connected to the first node and a second electrode connected to the output node.

In an embodiment, the flexible circuit substrate may further include a source switch which selectively connects the data channel to one of a plurality of data lines of the display panel.

In an embodiment, the display panel may further include a data line extending in the second direction and a sensing line extending in the second direction. The integral integrated circuit may further include a readout channel which receives a sensing signal from the sensing line.

In an embodiment, the sensing line may be provided in plurality, and the flexible circuit substrate may further include a sensing switch which selectively connects the readout channel to one of the plurality of sensing lines of the display panel.

According to the display apparatus, the gate driver and the data driver are disposed at one side (e.g., upper side in FIG. 1) of the display panel so that the bezel width of the side portion (e.g., left and right sides in the first direction DR1 in FIG. 1) of the display panel may be reduced. The gate driver and the data driver are formed as the integral integrated circuit so that the bezel width of the display apparatus may be reduced more effectively.

In addition, the level shifter of the gate signal may be formed on the display panel or the flexible circuit substrate so that the design constraints (i.e., the integral integrated circuit IIC cannot be located on the bezel area) of the integral integrated circuit due to a structure having the reduced bezel width may be overcome.

In addition, the gate driver may generate the gate signal by a decoding method so that the output sequence of the gate signal may be adjusted according to the input image data. Thus, the power consumption may be reduced.

In addition, the contact points where the horizontal gate lines and the vertical gate lines contact may be randomly disposed so that an oblique line stain generated when the contact points where the horizontal gate lines and the vertical gate lines contact in an oblique direction may be prevented.

BRIEF DESCRIPTION OF THE DRAWINGS

The above and other features and advantages of the present inventive concept will become more apparent by describing in detailed embodiments thereof with reference to the accompanying drawings, in which.

DETAILED DESCRIPTION

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Hereinafter, the present inventive concept will be explained in detail with reference to the accompanying drawings.

Figure 1:
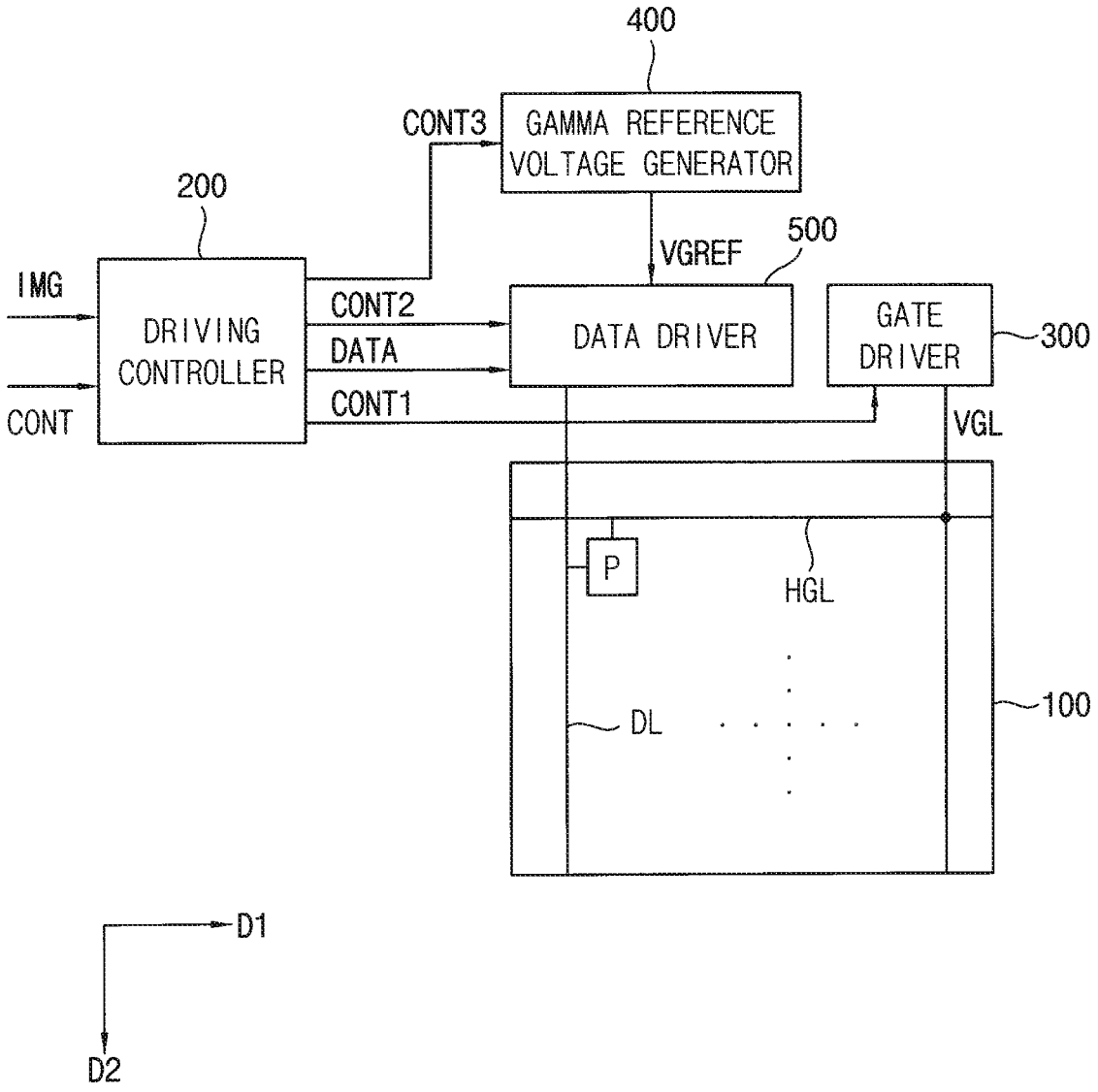
FIG. 1 is a block diagram illustrating a display apparatus according to an embodiment of the present inventive concept.

FIG. 1 is a block diagram illustrating a display apparatus according to an embodiment of the present inventive concept.

Referring to FIG. 1, the display apparatus includes a display panel 100 and a display panel driver. The display panel driver includes a driving controller 200, a gate driver 300, a gamma reference voltage generator 400 and a data driver 500.

The display panel 100 has a display region on which an image is displayed and a peripheral region adjacent to the display region.

The display panel 100 includes a plurality of gate lines HGL and VGL, a plurality of data lines DL and a plurality of pixels P. The plurality of pixels P is electrically connected to the gate lines HGL and VGL and the data lines DL. The first gate lines HGL may extend in a first direction D1, the second gate lines VGL may extend in a second direction D2 crossing the first direction D1, and the data lines DL may extend in the second direction D2. The first gate lines HGL and the second gate lines VGL may be connected to each other. For example, the first gate lines HGL and the second gate lines VGL may be connected one-to-one. For example, the number of the first gate lines HGL may be substantially the same as the number of the second gate lines VGL. The first gate lines HGL may be referred to horizontal gate lines. The second gate lines VGL may be referred to vertical gate lines.

The driving controller 200 receives input image data IMG and an input control signal CONT from an external apparatus. The input image data IMG may include red image data, green image data and blue image data. The input image data IMG may include white image data. In another embodiment, the input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA, based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines HGL and VGL in response to the first control signal CONT1 received from the driving controller 200. The gate driver 300 outputs the gate signals to the gate lines HGL and VGL. For example, the gate driver 300 may sequentially output the gate signals to the gate lines HGL and VGL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
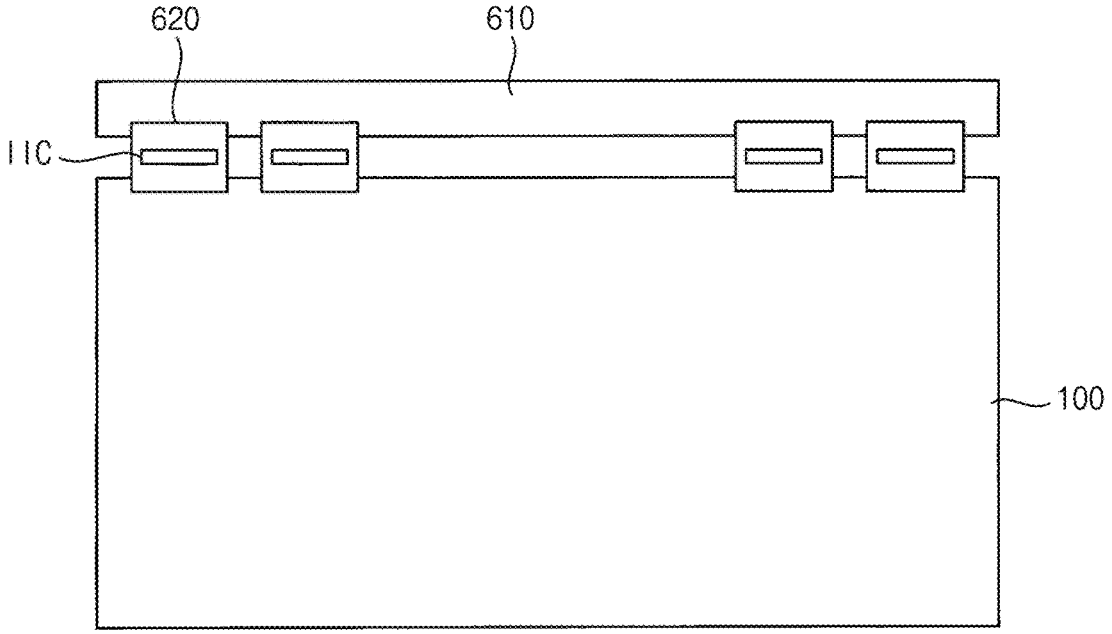
FIG. 2 is a plan view illustrating a display apparatus of FIG. 1.
Figure 3:
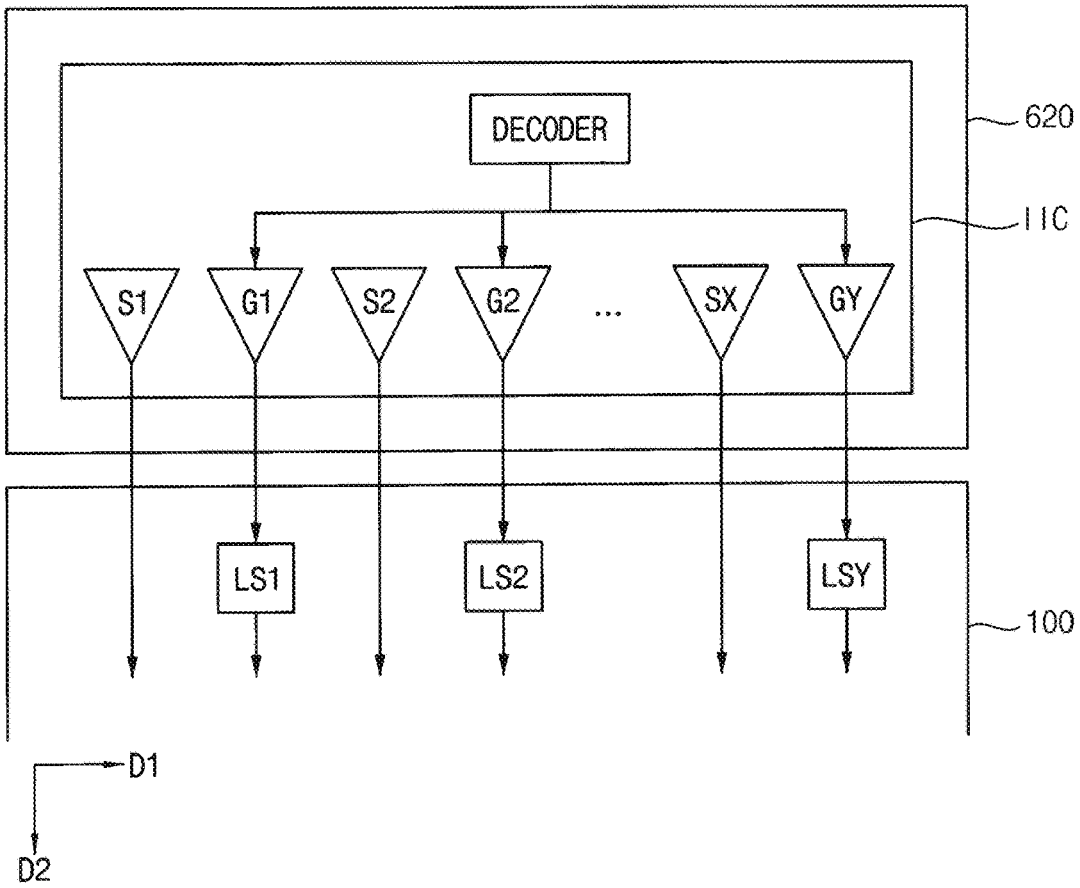
FIG. 3 is a plan view illustrating an embodiment of a flexible circuit substrate and an integral integrated circuit of FIG. 2 and a display panel of FIG. 1.

FIG. 2 is a plan view illustrating a display apparatus of FIG. 1. FIG. 3 is a plan view illustrating an embodiment of a flexible circuit substrate and an integral integrated circuit of FIG. 2 and a display panel of FIG. 1.

Referring to FIGS. 1 to 3, the display apparatus includes the display panel 100 and the display panel driver. The display panel driver may include a printed circuit board ("PCB") 610 and a plurality of flexible circuit substrates (flexible printed circuit boards, "FPC") 620.

A first side of the flexible circuit substrate 620 is connected to the display panel 100 and a second side of the flexible circuit substrate 620 is connected to the printed circuit board 610. The first side of the flexible circuit substrate 620 is opposite to the second side of the flexible circuit substrate 620.

The flexible circuit substrate 620 includes a flexible material. The flexible circuit substrate 620 may cover a side surface of the display panel 100. Thus, the printed circuit board 610 may be bended toward a rear surface of the display panel 100.

In an embodiment, for example, the flexible circuit substrate 620 may be disposed at one side of the display panel 100. The flexible circuit substrate 620 may be disposed at an upper side of the display panel 100.

An integral integrated circuit IIC operating an operation of the gate driver 300 and an operation of the data driver 500 may be disposed on the flexible circuit substrate 620. For example, one integral integrated circuit IIC may be disposed on one flexible circuit substrate 620. Alternatively, a plurality of the integral integrated circuits IIC may be disposed on one flexible circuit substrate 620.

The printed circuit board 610 may include the driving controller 200.

The integral integrated circuit IIC may include a gate channel G1, G2, . . . , GY outputting a gate primitive signal and a data channel S1, S2, . . . , SX outputting the data voltage. Herein, X and Y are positive integers. X and Y may be different from each other. For example, the number (e.g., X) of the data channels may be greater than the number (e.g., Y) of the gate channels.

The display panel 100 may include a level shifter LS1, LS2, . . . , LSY amplifying the gate primitive signal to generate the gate signal. For example, the number of the level shifters may be equal to the number of the gate channels. The display panel 100 may display an image based on the gate signal and the data voltage.

The display panel 100 may include a first gate line HGL extending in the first direction D1, a second gate line VGL extending in the second direction D2 and the data line DL extending in the second direction D2. The second direction DR2 is different from the first direction D1, and the second gate line VGL is connected to the first gate line HGL. The level shifter LS1, LS2, . . . , LSY may be connected to the second gate line VGL.

As shown in FIG. 3, the integral integrated circuit IIC may further include a decoder connected to the gate channels G1, G2, . . . , GY and selectively outputting the gate primitive signal to one of the gate channels G1, G2, . . . , GY.

An output sequence of the gate primitive signal of the gate channels G1, G2, . . . , GY may be adjusted using the decoder. The driving controller may control the output sequence of the gate primitive signal of the gate channels G1, G2, . . . , GY. The driving controller 200 may remap the data signal DATA corresponding to the output sequence of the gate primitive signal of the gate channels G1, G2, . . . , GY. Thus, the driving controller 200 may analyze the input image data IMG, may determine the output sequence of the gate primitive signal of the gate channels G1, G2, . . . , GY and may remap the output of the data signal DATA such that the power consumption of the display apparatus is minimized.

Figure 4:
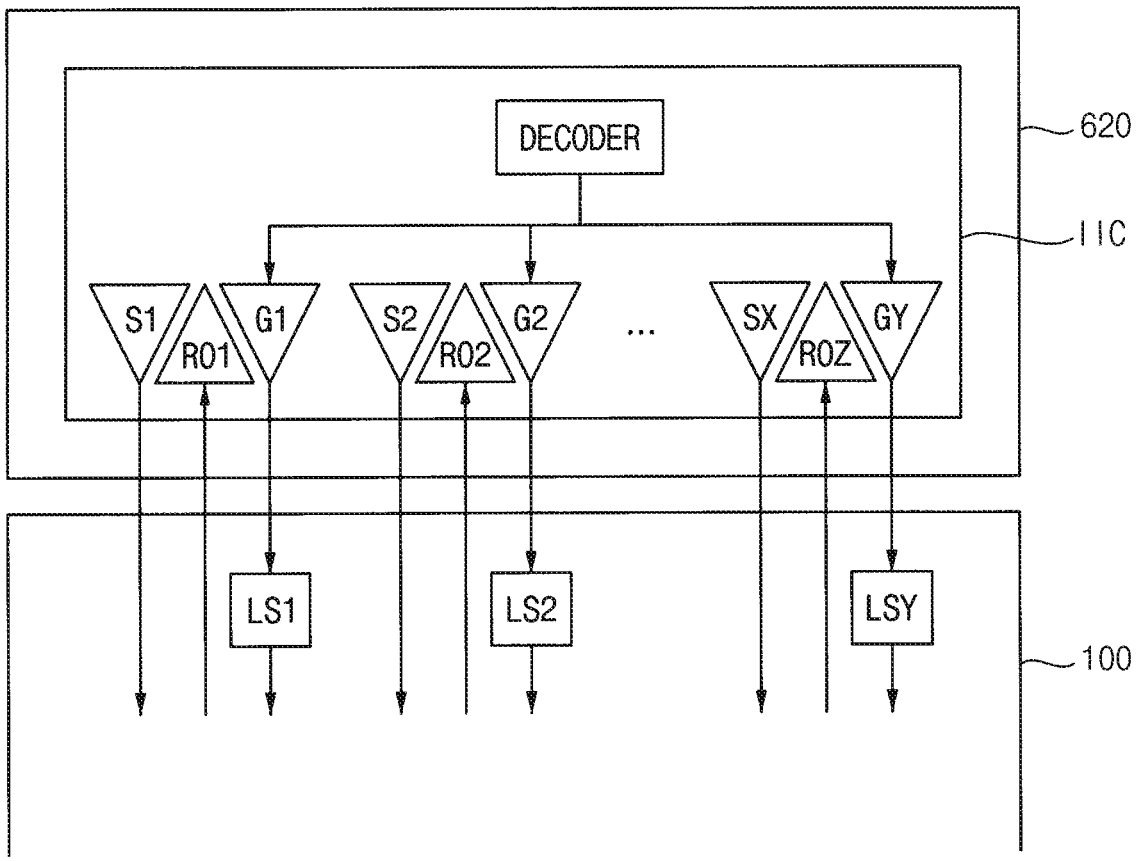
FIG. 4 is a plan view illustrating another embodiment of the flexible circuit substrate and the integral integrated circuit of FIG. 2 and the display panel of FIG. 1.

FIG. 4 is a plan view illustrating another embodiment of the flexible circuit substrate and the integral integrated circuit of FIG. 2 and the display panel of FIG. 1.

Referring to FIGS. 1, 2 and 4, the display panel 100 may include a first gate line HGL extending in the first direction D1, a second gate line VGL extending in the second direction D2 different from the first direction D1 and connected to the first gate line HGL and a sensing line (not shown) extending in the second direction D2.

The integral integrated circuit IIC may further include a read-out channel RO1, RO2, . . . , ROZ receiving a sensing signal from the sensing line. Herein, Z is a positive integer. Z may be different from X and Y. Alternatively, Z may be equal to X. The sensing line may be connected to the pixel P of the display panel 100 and may sense a current or a voltage of the pixel P to determine a threshold voltage of a transistor of the pixel P. The driving controller 200 may output a compensated data signal DATA based on the sensed threshold voltage of the transistor of the pixel P to the data driver 500 or the integral integrated circuit IIC.

Figure 5:
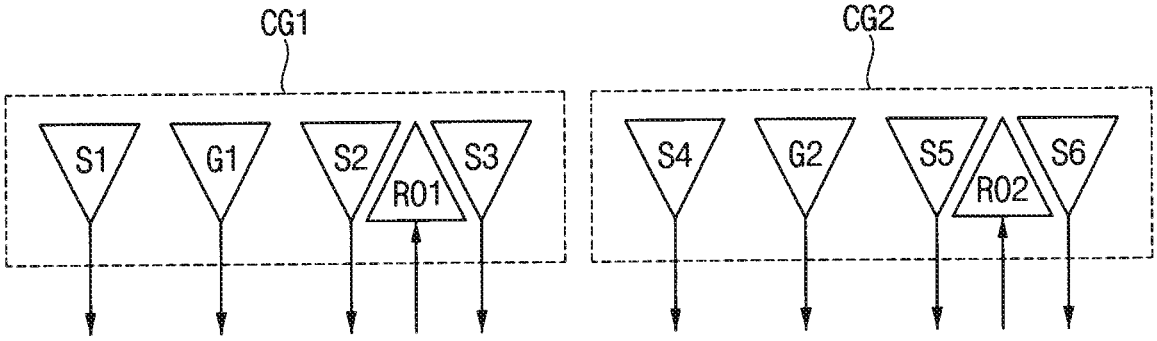
FIG. 5 is a schematic diagram illustrating an example structure of channels of integral integrated circuit of FIG. 2.

FIG. 5 is a schematic diagram illustrating an example structure of channels of integral integrated circuit of FIG. 2.

Referring to FIGS. 1, 2 and 5, the integral integrated circuit IIC may include a repeating channel group (e.g., CG1 and CG2).

A first channel group CG1 may include a first data channel S1, a first gate channel G1, a second data channel S2, a first readout channel RO1 and a third data channel S3. For example, the first data channel S1, the first gate channel G1, the second data channel S2, the first readout channel RO1 and the third data channel S3 may be sequentially disposed in the first channel group CG1.

A second channel group CG2 may include a fourth data channel S4, a second gate channel G2, a fifth data channel S5, a second readout channel RO2 and a sixth data channel S6. For example, the fourth data channel S4, the second gate channel G2, the fifth data channel S5, the second readout channel RO2 and the sixth data channel S6 may be sequentially disposed in the second channel group CG2.

Figure 6:
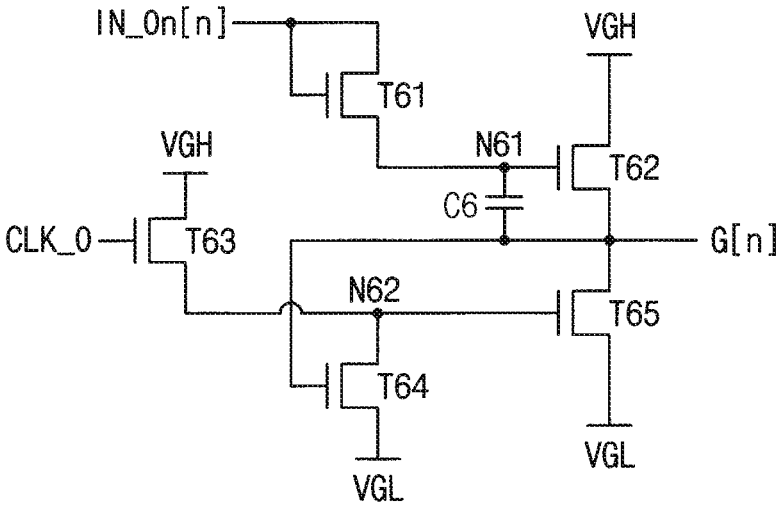
FIG. 6 is a circuit diagram illustrating a level shifter of FIG. 3.
Figure 7:
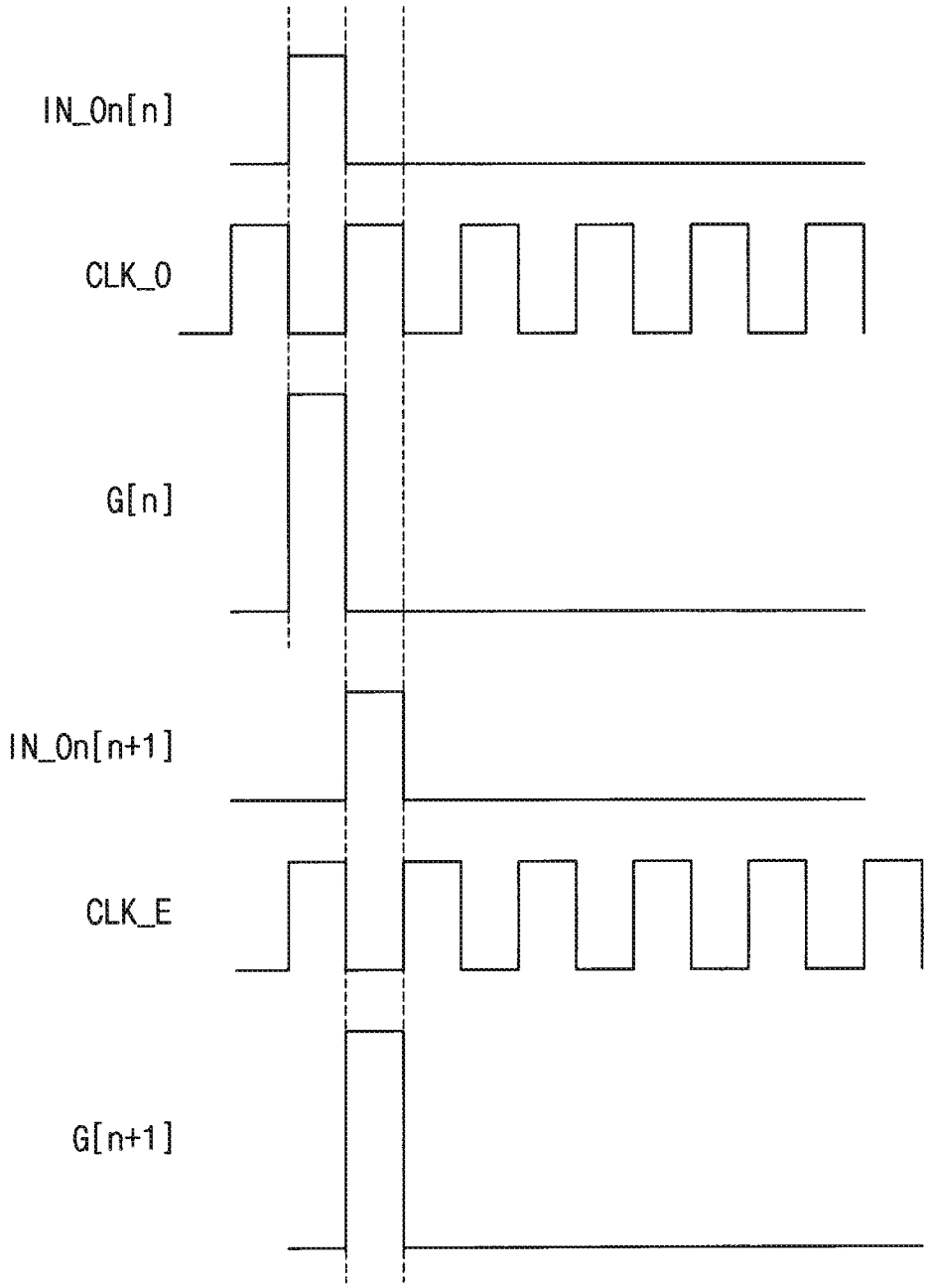
FIG. 7 is a timing diagram illustrating an input signal and an output signal of the level shifter of FIG. 3.
Figure 8:
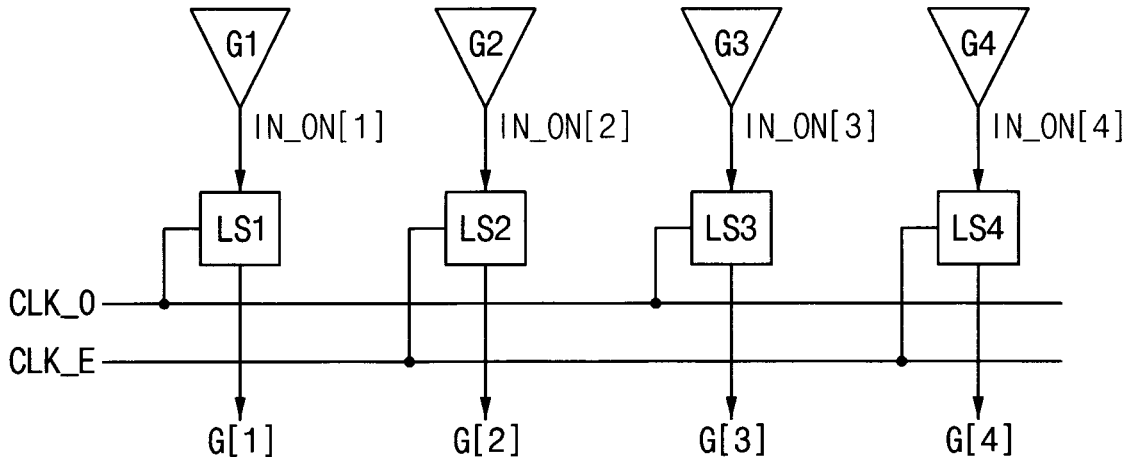
FIG. 8 is a schematic diagram illustrating connecting between a gate channel of the integral integrated circuit of FIG. 2 and the level shifter of the display panel of FIG. 1.

FIG. 6 is a circuit diagram illustrating a level shifter of FIG. 3. FIG. 7 is a timing diagram illustrating an input signal and an output signal of the level shifter of FIG. 3. FIG. 8 is a schematic diagram illustrating connecting between a gate channel of the integral integrated circuit of FIG. 2 and the level shifter of the display panel of FIG. 1.

Referring to FIGS. 1 to 8, when the pixel P of the display panel 100 includes an N-type transistor, the level shifter may also include an N-type transistor.

The display panel 100 may include first, second, third and fourth level shifters LS1, LS2, LS3 and LS4 which are sequentially disposed. The first, second, third and fourth level shifters LS1, LS2, LS3 and LS4 may be connected to first, second, third and fourth gate channels G1, G2, G3 and G4, respectively.

The first level shifter LS1 and the third level shifter LS3 may be connected to a first clock line applying a first clock signal CLK_O, and the second level shifter LS2 and the fourth level shifter LS4 may be connected to a second clock line applying a second clock signal CLK_E.

As shown in FIG. 6, an n-th level shifter (e.g., the first level shifter LS1 or the third level shifter LS3) may include first to fifth transistors T61 to T65 and a capacitor C6. The first transistor T61 includes a control electrode receiving the gate primitive signal IN_On[n], an input electrode receiving the gate primitive signal IN_On[n] and an output electrode connected to a first node N61. The second transistor T62 includes a control electrode connected to the first node N61, an input electrode receiving a first gate power voltage VGH and an output electrode connected to an output node. The third transistor T63 includes a control electrode connected to the first clock line and receiving the first clock signal CLK_O, an input electrode receiving the first gate power voltage VGH and an output electrode connected to a second node N62. The fourth transistor T64 includes a control electrode connected to the output node, an input electrode connected to the second node N62 and an output electrode receiving a second gate power voltage VGL. The fifth transistor T65 includes a control electrode connected to the second node N62, an input electrode connected to the output node and an output electrode receiving the second gate power voltage VGL. The capacitor C6 includes a first electrode connected to the first node N61 and a second electrode connected to the output node.

Herein, the first to fifth transistors T61 to T65 may be N-type transistors. The control electrodes of the first to fifth transistors T61 to T65 may be gate electrodes, the input electrodes of the first to fifth transistors T61 to T65 may be source electrodes and the output electrodes of the first to fifth transistors T61 to T65 may be drain electrodes.

The first gate power voltage VGH may be greater than the second gate power voltage VGL. The first gate power voltage VGH may represent a high level of the gate signal G[n] and the second gate power voltage VGL may represent a low level of the gate signal G[n].

The gate signal G[n] having an amplitude greater than an amplitude of the gate primitive signal IN_On[n] may be generated by the level shifter.

As shown in FIG. 7, an n+1-th level shifter (e.g., the second level shifter LS2 or the fourth level shifter LS4) may convert the gate primitive signal IN_On[n+1] into the gate signal G[n+1] based on the second clock signal CLK_E.

Figure 18:
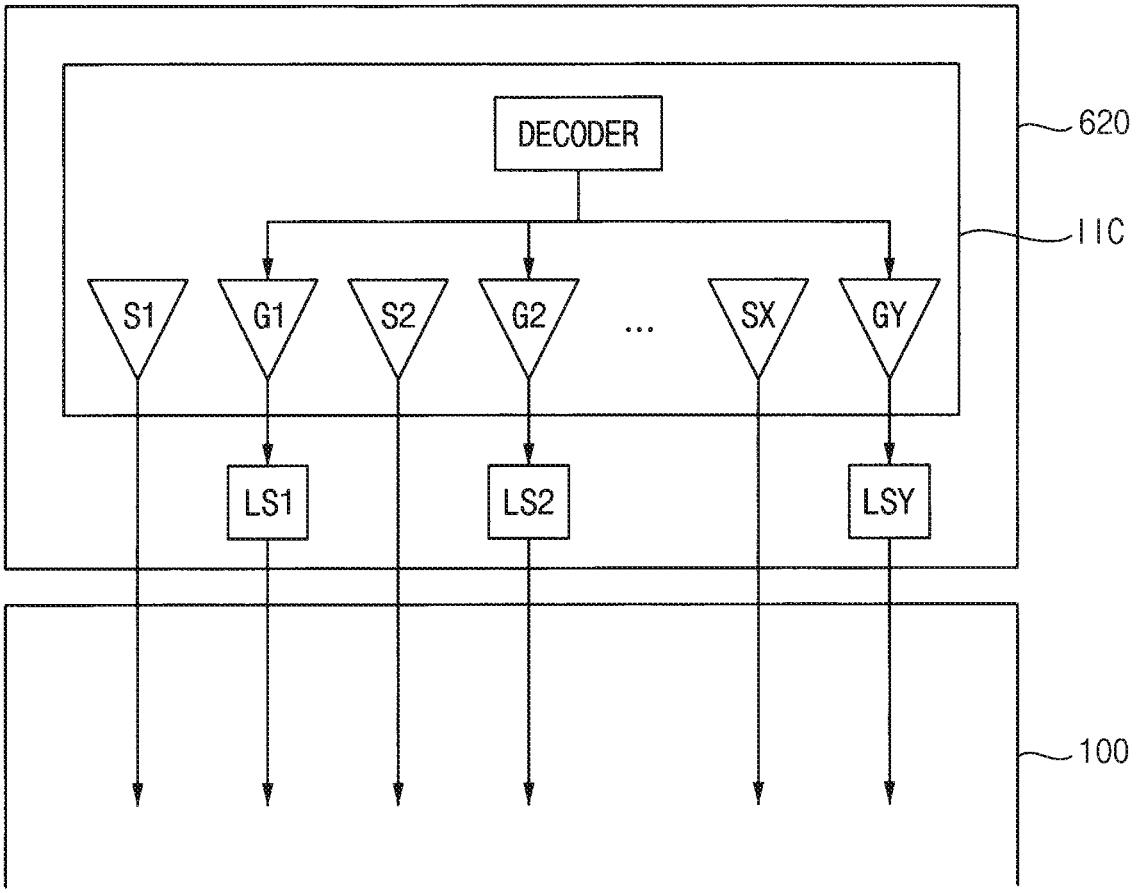
FIG. 18 is a plan view illustrating an example structure of a flexible circuit substrate, an integral integrated circuit and a display panel of a display apparatus according to another embodiment of the present inventive concept.

Although, for example, the level shifter is disposed on the display panel 100 in the present embodiment, the level shifter may be disposed on the flexible circuit substrate 620 as shown in FIG. 18.

According to the present embodiment, the gate driver 300 and the data driver 500 are disposed at one side (e.g., upper side in FIG. 1) of the display panel 100 so that the bezel width of the side portion (e.g., left and right sides in the first direction DR1 in FIG. 1) of the display panel 100 may be reduced. The gate driver 300 and the data driver 500 are formed as the integral integrated circuit IIC so that the bezel width of the display apparatus may be reduced more effectively.

In addition, the level shifter of the gate signal may be disposed on the display panel 100 so that the design constraints (i.e., the integral integrated circuit IIC cannot be located on the bezel area) of the integral integrated circuit IIC due to a structure having the reduced bezel width may be overcome.

In addition, in the gate driver 300 the gate signal may be generated by a decoding method so that the output sequence of the gate signal may be adjusted according to the input image data IMG. Thus, the power consumption may be reduced.

Figure 9:
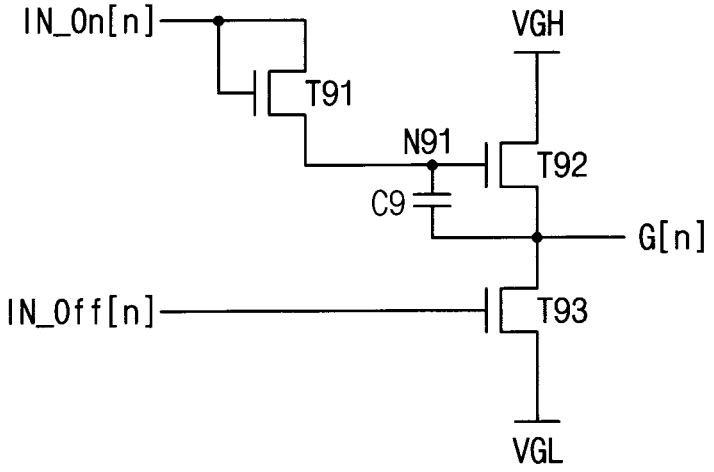
FIG. 9 is a circuit diagram illustrating a level shifter of a display apparatus according to another embodiment of the present inventive concept.
Figure 10:
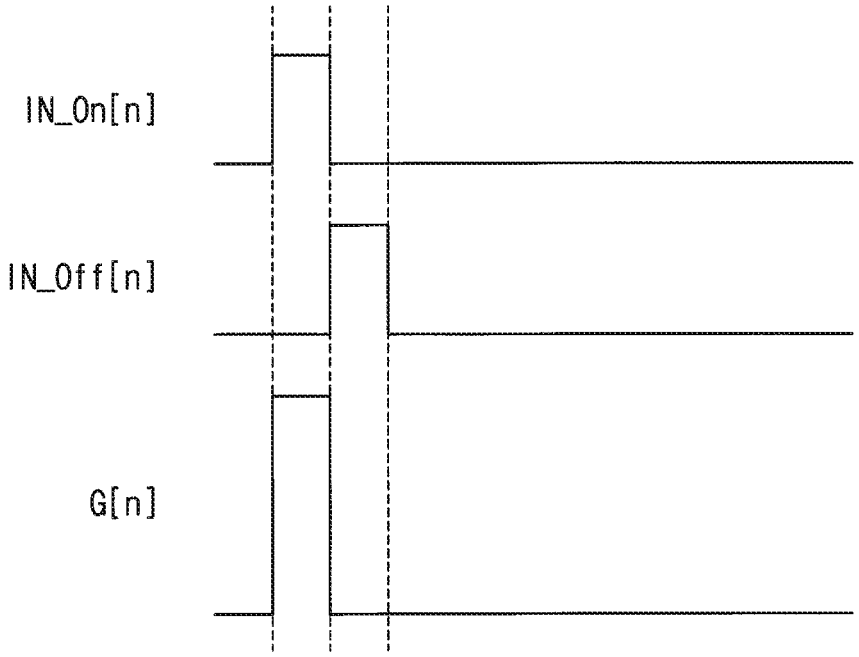
FIG. 10 is a timing diagram illustrating an input signal and an output signal of the level shifter of FIG. 9.
Figure 11:
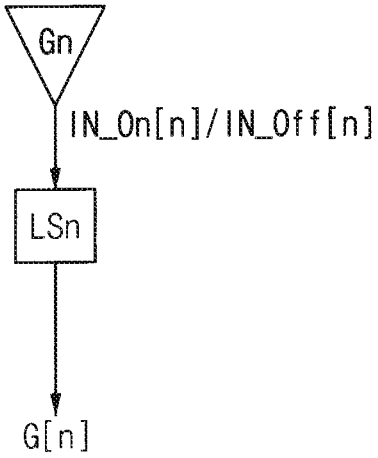
FIG. 11 is a schematic diagram illustrating connecting between a gate channel of an integral integrated circuit of the display apparatus of FIG. 3 and the level shifter of FIG. 9.

FIG. 9 is a circuit diagram illustrating a level shifter of a display apparatus according to another embodiment of the present inventive concept. FIG. 10 is a timing diagram illustrating an input signal and an output signal of the level shifter of FIG. 9. FIG. 11 is a schematic diagram illustrating connecting between a gate channel of an integral integrated circuit of the display apparatus of FIG. 3 and the level shifter of FIG. 9.

The display apparatus according to the present embodiment is substantially the same as the display apparatus of the previous embodiment explained referring to FIGS. 1 to 8 except for the circuit structure of the level shifter. Thus, the same reference numerals will be used to refer to the same or like parts as those described in the previous embodiment of FIGS. 1 to 8 and any repetitive explanation concerning the above elements will be omitted.

Referring to FIGS. 1 to 5 and 9 to 11, when the pixel P of the display panel 100 includes an N-type transistor, the level shifter may also include an N-type transistor.

The level shifter includes first to third transistors T91 to T93 and a capacitor C9. The first transistor T91 includes a control electrode receiving the gate primitive signal IN_On [n], an input electrode receiving the gate primitive signal IN_On[n] and an output electrode connected to a first node N91. The second transistor T92 includes a control electrode connected to the first node N91, an input electrode receiving a first gate power voltage VGH and an output electrode connected to an output node. The third transistor T93 includes a control electrode receiving a gate off signal IN_Off[n], an input electrode connected to the output node and an output electrode receiving a second gate power voltage VGL. The capacitor C9 includes a first electrode connected to the first node N91 and a second electrode connected to the output node.

Herein, first to third transistors T91 to T93 may be N-type transistors. The control electrodes of the first to third transistors T91 to T93 may be gate electrodes, the input electrodes of the first to third transistors T91 to T93 may be source electrodes, and the output electrodes of the first to third transistors T91 to T93 may be drain electrodes.

As shown in FIG. 11, the gate channel Gn may output the gate primitive signal IN_On[n] and a gate off signal IN_Off [n] having a timing later than the gate primitive signal IN_On[n] to the level shifter LSn.

The first gate power voltage VGH may be greater than the second gate power voltage VGL. The first gate power voltage VGH may represent a high level of the gate signal G[n] and the second gate power voltage VGL may represent a low level of the gate signal G[n].

The gate signal G[n] having an amplitude greater than an amplitude of the gate primitive signal IN_On[n] may be generated by the level shifter LSn.

Although, for example, the level shifter is disposed on the display panel 100 in the present embodiment, the level shifter may be disposed on the flexible circuit substrate 620 as shown in FIG. 18.

According to the present embodiment, the gate driver 300 and the data driver 500 are disposed at one side (e.g., upper side in FIG. 1) of the display panel 100 so that the bezel width of the side portion (e.g., left and right sides in the first direction DR1 in FIG. 1) of the display panel 100 may be reduced. The gate driver 300 and the data driver 500 are formed as the integral integrated circuit IIC so that the bezel width of the display apparatus may be reduced more effectively.

In addition, the level shifter of the gate signal may be disposed on the display panel 100 so that the design constraints (i.e., the integral integrated circuit IIC cannot be located on the bezel area) of the integral integrated circuit IIC due to a structure having the reduced bezel width may be overcome.

In addition, in the gate driver 300 the gate signal may be generated by a decoding method so that the output sequence of the gate signal may be adjusted according to the input image data IMG. Thus, the power consumption may be reduced.

Figure 12:
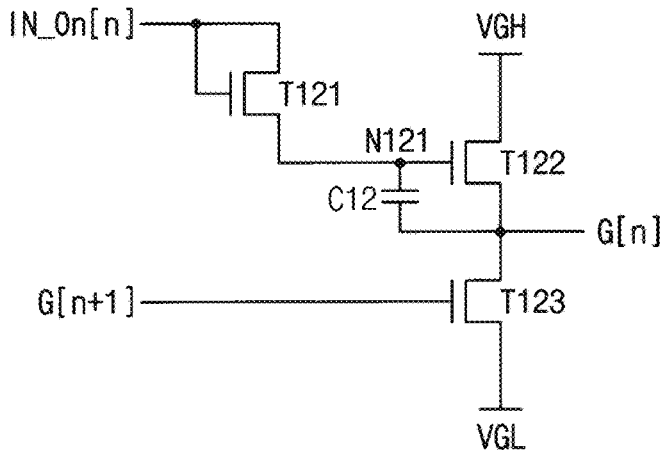
FIG. 12 is a circuit diagram illustrating a level shifter of a display apparatus according to still another embodiment of the present inventive concept.
Figure 13:
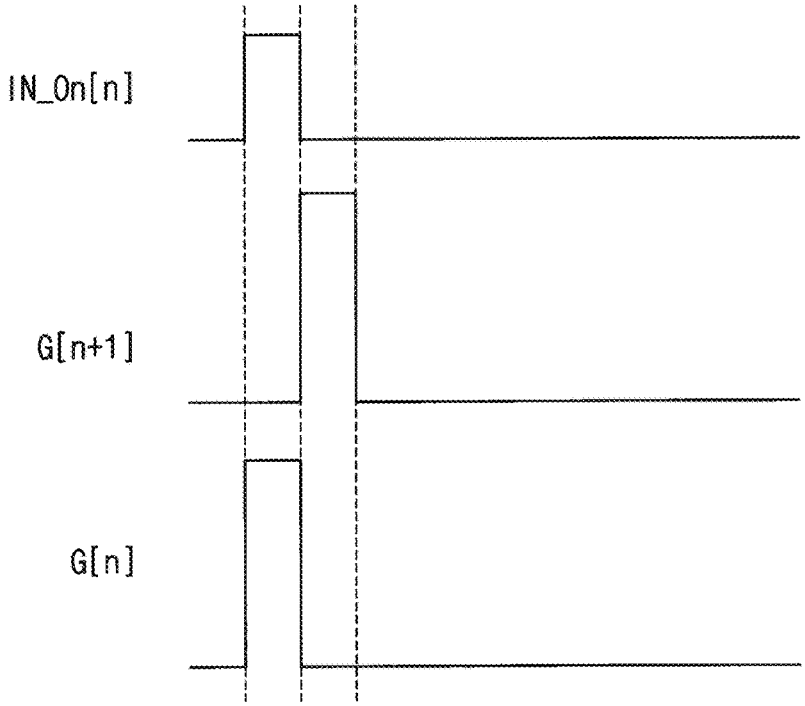
FIG. 13 is a timing diagram illustrating an input signal and an output signal of the level shifter of FIG. 12.
Figure 14:
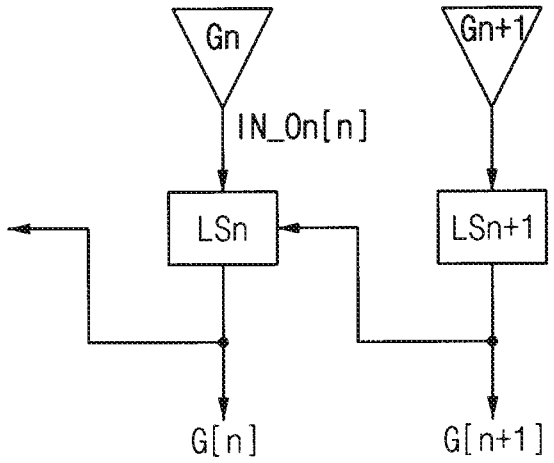
FIG. 14 is a schematic diagram illustrating connecting between a gate channel of an integral integrated circuit of the display apparatus of FIG. 12 and the level shifter of FIG. 12.

FIG. 12 is a circuit diagram illustrating a level shifter of a display apparatus according to still another embodiment of the present inventive concept. FIG. 13 is a timing diagram illustrating an input signal and an output signal of the level shifter of FIG. 12. FIG. 14 is a schematic diagram illustrating connecting between a gate channel of an integral integrated circuit of the display apparatus according to the invention and the level shifter of FIG. 12.

The display apparatus according to the present embodiment is substantially the same as the display apparatus of the previous embodiment explained referring to FIGS. 1 to 8 except for the circuit structure of the level shifter. Thus, the same reference numerals will be used to refer to the same or like parts as those described in the previous embodiment of FIGS. 1 to 8 and any repetitive explanation concerning the above elements will be omitted.

Referring to FIGS. 1 to 5 and 12 to 14, when the pixel P of the display panel 100 includes an N-type transistor, the level shifter may also include an N-type transistor.

As shown in FIG. 14, an n-th level shifter LSn may receive an n-th gate primitive signal IN_On[n] from an n-th gate channel Gn, may receive an n+1-th gate signal G[n+1] from an n+1-th level shifter LSn+1 and may output an n-th gate signal G[n].

The n-th level shifter LSn includes the first to third transistors T121 to T123 and a capacitor C12. The first transistor T121 includes a control electrode receiving the n-th gate primitive signal IN_On[n], an input electrode receiving the n-th gate primitive signal IN_On[n] and an output electrode connected to a first node N121. The second transistor T122 includes a control electrode connected to the first node N121, an input electrode receiving a first gate power voltage VGH and an output electrode connected to an output node. The third transistor T123 includes a control electrode receiving the n+1-th gate signal G[n+1], an input electrode connected to the output node and an output electrode receiving a second gate power voltage VGL. The capacitor C12 includes a first electrode connected to the first node N121 and a second electrode connected to the output node.

Herein, first to third transistors T121 to T123 may be N-type transistors. The control electrodes of the first to third transistors T121 to T123 may be gate electrodes, the input electrodes of the first to third transistors T121 to T123 may be source electrodes and the output electrodes of the first to third transistors T121 to T123 may be drain electrodes.

In the present embodiment, the gate off signal IN_Off[n] of FIG. 11 may be replaced with the n+1-th gate signal G[n+1] of FIG. 13.

The first gate power voltage VGH may be greater than the second gate power voltage VGL. The first gate power voltage VGH may represent a high level of the gate signal G[n] and the second gate power voltage VGL may represent a low level of the gate signal G[n].

The gate signal G[n] having an amplitude greater than an amplitude of the gate primitive signal IN_On[n] may be generated by the level shifter.

Although, for example, the level shifter is disposed on the display panel 100 in the present embodiment, the level shifter may be disposed on the flexible circuit substrate 620 as shown in FIG. 18.

According to the present embodiment, the gate driver 300 and the data driver 500 are disposed at one side (e.g., upper side in FIG. 1) of the display panel 100 so that the bezel width of the side portion (e.g., left and right sides in the first direction DR1 in FIG. 1) of the display panel 100 may be reduced. The gate driver 300 and the data driver 500 are formed as the integral integrated circuit IIC so that the bezel width of the display apparatus may be reduced more effectively.

In addition, the level shifter of the gate signal may be formed on the display panel 100 so that the design constraints (i.e., the integral integrated circuit IIC cannot be located on the bezel area) of the integral integrated circuit IIC due to a structure having the reduced bezel width may be overcome.

In addition, in the gate driver 300 the gate signal may be generated by a decoding method so that the output sequence of the gate signal may be adjusted according to the input image data IMG. Thus, the power consumption may be reduced.

Figure 15:
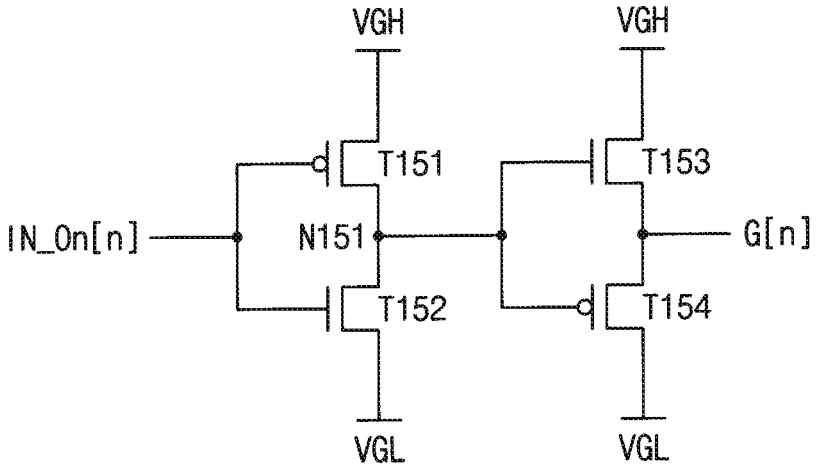
FIG. 15 is a circuit diagram illustrating a level shifter of a display apparatus according to yet another embodiment of the present inventive concept.
Figure 16:
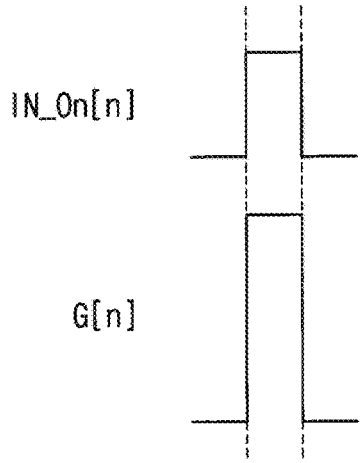
FIG. 16 is a timing diagram illustrating an input signal and an output signal of the level shifter of FIG. 15.

FIG. 15 is a circuit diagram illustrating a level shifter of a display apparatus according to yet another embodiment of the present inventive concept. FIG. 16 is a timing diagram illustrating an input signal and an output signal of the level shifter of FIG. 15.

The display apparatus according to the present embodiment is substantially the same as the display apparatus of the previous embodiment explained referring to FIGS. 1 to 8 except for the circuit structure of the level shifter. Thus, the same reference numerals will be used to refer to the same or like parts as those described in the previous embodiment of FIGS. 1 to 8 and any repetitive explanation concerning the above elements will be omitted.

Referring to FIGS. 1 to 5, 15 and 16, when the pixel P of the display panel 100 includes an N-type transistor and a P-type transistor, the level shifter may also include an N-type transistor and a P-type transistor.

The level shifter includes first to fourth transistors T151 to T154. The first transistor T151 includes a control electrode receiving a gate primitive signal IN_On[n], an input electrode receiving a first gate power voltage VGH and an output electrode connected to a first node N151. The second transistor T152 includes a control electrode receiving the gate primitive signal IN_On[n], an input electrode connected to the first node N151 and an output electrode receiving a second gate power voltage VGL. The third transistor T153 includes a control electrode connected to the first node N151, an input electrode receiving the first gate power voltage VGH and an output electrode connected to an output node. The fourth transistor T154 including a control electrode connected to the first node N151, an input electrode connected to the output node and an output electrode receiving the second gate power voltage VGL.

The first transistor T151 and the fourth transistor T154 may be P-type transistors. The second transistor T152 and the third transistor T153 may be N-type transistors.

The gate primitive signal IN_On[n] may be inverted and amplified by the first transistor T151 and the second transistor T152 so that the inverted and amplified signal may be outputted to the first node N151. The signal of the first node N151 may be inverted again by the third transistor T153 and the fourth transistor T154 so that the gate signal G[n] is outputted to the output node.

The first gate power voltage VGH may be greater than the second gate power voltage VGL. The first gate power voltage VGH may represent a high level of the gate signal G[n] and the second gate power voltage VGL may represent a low level of the gate signal G[n].

The gate signal G[n] having an amplitude greater than an amplitude of the gate primitive signal IN_On[n] may be generated by the level shifter.

Although, for example, the level shifter is disposed on the display panel 100 in the present embodiment, the level shifter may be disposed on the flexible circuit substrate 620 as shown in FIG. 18.

According to the present embodiment, the gate driver 300 and the data driver 500 are disposed at one side (e.g., upper side in FIG. 1) of the display panel 100 so that the bezel width of the side portion (e.g., left and right sides in the first direction DR1 in FIG. 1) of the display panel 100 may be reduced. The gate driver 300 and the data driver 500 are formed as the integral integrated circuit IIC so that the bezel width of the display apparatus may be reduced more effectively.

In addition, the level shifter of the gate signal may be formed on the display panel 100 so that the design constraints (i.e., the integral integrated circuit IIC cannot be located on the bezel area) of the integral integrated circuit IIC due to a structure having the reduced bezel width may be overcome.

In addition, in the gate driver 300 the gate signal may be generated by a decoding method so that the output sequence of the gate signal may be adjusted according to the input image data IMG. Thus, the power consumption may be reduced.

Figure 17:
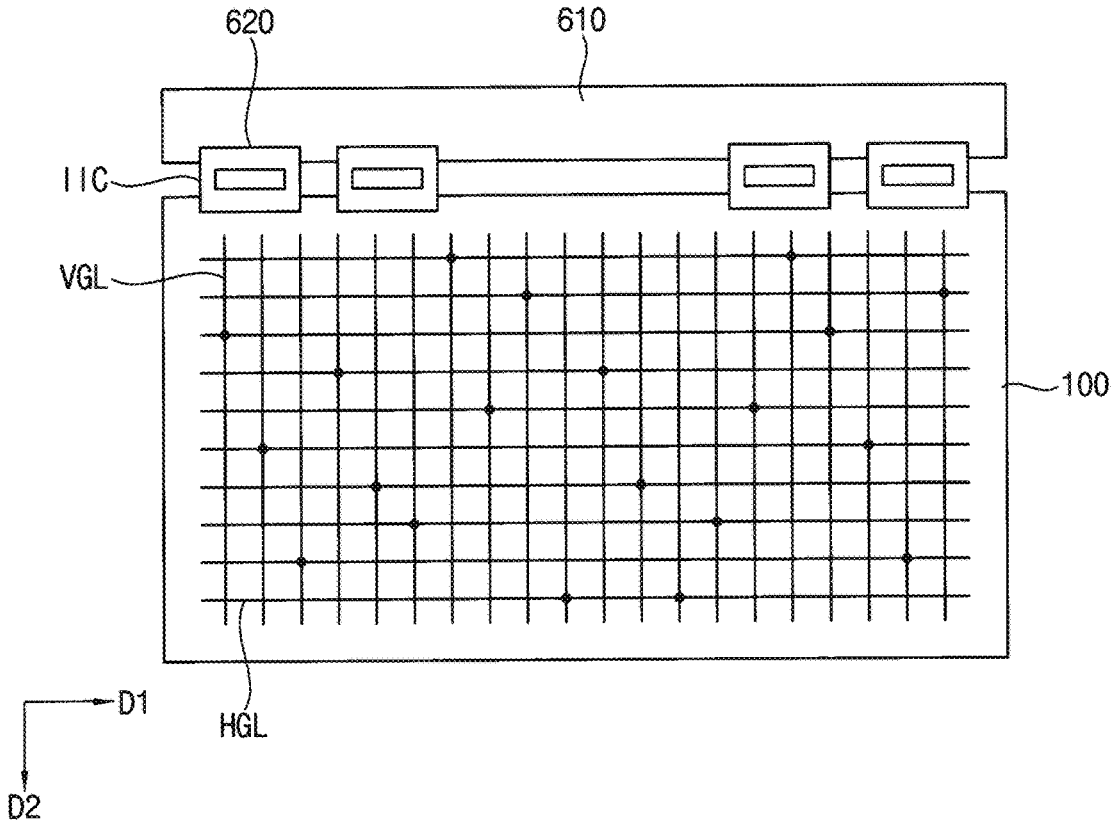
FIG. 17 is a schematic diagram illustrating a structure of gate lines of a display panel of a display apparatus according to an embodiment of the present inventive concept.

FIG. 17 is a schematic diagram illustrating a structure of gate lines of a display panel of a display apparatus according to an embodiment of the present inventive concept.

Referring to FIGS. 1 to 8 and 17, the display apparatus includes the display panel 100 and the display panel driver. The display panel driver may include a printed circuit board (PCB) 610 and a plurality of flexible circuit substrates (flexible printed circuit boards, FPC) 620.

A first side of the flexible circuit substrate 620 is connected to the display panel 100 and a second side of the flexible circuit substrate 620 is connected to the printed circuit board 610.

An integral integrated circuit IIC performing an operation of the gate driver 300 and an operation of the data driver 500 may be disposed on the flexible circuit substrate 620. For example, one integral integrated circuit IIC may be disposed on one flexible circuit substrate 620. Alternatively, a plurality of the integral integrated circuits IIC may be disposed on one flexible circuit substrate 620.

The display panel 100 may include first gate lines HGL extending in the first direction D1, the second gate lines VGL extending in the second direction D2 different from the first direction D1 and contact points connecting the first gate lines HGL and the second gate lines VGL.

The integral integrated circuit IIC may output the gate signal to the second gate lines VGL. The gate signal may be transmitted to the first gate lines HGL through the contact points.

In the present embodiment, the contact points may form an atypical random pattern.

In the present embodiment, the contact points where the horizontal gate lines HGL and the vertical gate lines VGL contact may be randomly disposed so that an oblique line stain generated when the contact points where the horizontal gate lines HGL and the vertical gate lines VGL contact are arranged in an oblique direction may be prevented.

In addition, the integral integrated circuit IIC may further include a decoder connected to the gate channels G1, G2, . . . , GY and selectively outputting the gate primitive signal to one of the gate channels G1, G2, . . . , GY.

An output sequence of the gate primitive signal of the gate channels G1, G2, . . . , GY may be adjusted using the decoder. The driving controller may control the output sequence of the gate primitive signal of the gate channels G1, G2, . . . , GY. The driving controller 200 may remap the data signal DATA corresponding to the output sequence of the gate primitive signal of the gate channels G1, G2, . . . , GY. Thus, the driving controller 200 may analyze the input image data IMG, may determine the output sequence of the gate primitive signal of the gate channels G1, G2, . . . , GY and may remap the output of the data signal DATA such that the power consumption of the display apparatus is minimized.

In addition, the decoder may adjust the output sequence of the gate primitive signal to correspond to the randomly disposed contact points.

Figure 19:
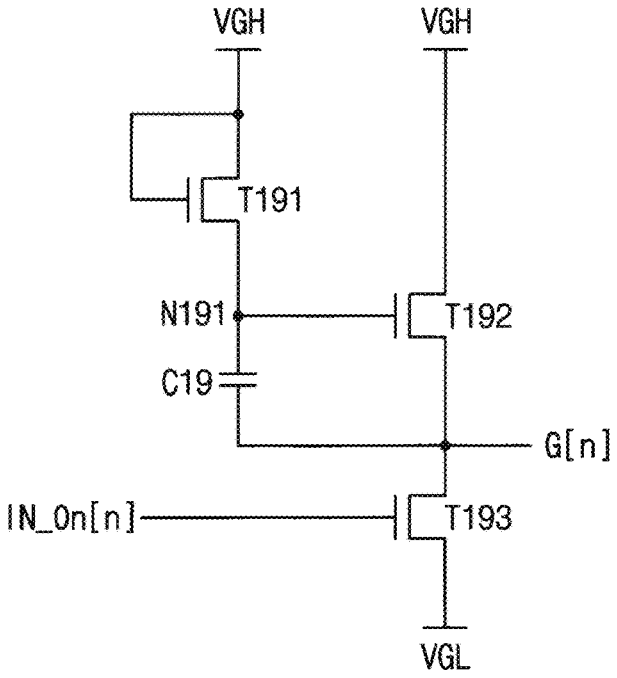
FIG. 19 is a circuit diagram illustrating a level shifter of FIG. 18.
Figure 20:
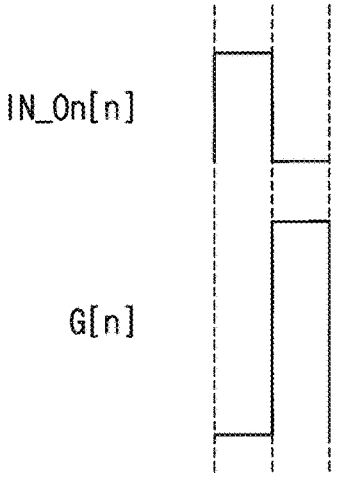
FIG. 20 is a timing diagram illustrating an input signal and an output signal of the level shifter of FIG. 19.

FIG. 18 is a plan view illustrating an example structure of a flexible circuit substrate, an integral integrated circuit and a display panel of a display apparatus according to another embodiment of the present inventive concept. FIG. 19 is a circuit diagram illustrating a level shifter of FIG. 18. FIG. 20 is a timing diagram illustrating an input signal and an output signal of the level shifter of FIG. 19.

Referring to FIGS. 1, 2 and 18 to 20, the display apparatus may include an integral integrated circuit IIC including a gate channel G1, G2, . . . , GY outputting a gate primitive signal and a data channel S1, S2, . . . , SX outputting a data voltage, a flexible circuit substrate 620 including a level shifter LS1, LS2, . . . , LSY amplifying the gate primitive signal and generating the gate signal and a display panel 100 connected to the flexible circuit substrate 620 and displaying an image based on the gate signal and the data voltage.

In the present embodiment, the integral integrated circuit IIC may be disposed on the flexible circuit substrate 620.

The level shifter may include first to third transistors T191 to T193 and a capacitor C19. The first transistor T191 includes a control electrode receiving a first gate power voltage VGH, an input electrode receiving the first gate power voltage VGH and an output electrode connected to the first node N191. The second transistor T192 includes a control electrode connected to the first node N191, an input electrode receiving the first gate power voltage VGH and an output electrode connected to an output node. The third transistor T193 includes a control electrode receiving the gate primitive signal IN_On[n], an input electrode connected to the output node and an output electrode receiving a second gate power voltage VGL. The capacitor C19 includes a first electrode connected to the first node N191 and a second electrode connected to the output node.

As shown in FIG. 20, the gate primitive signal IN_On[n] having a first timing may be converted to the gate signal G[n] having a second timing.

The first gate power voltage VGH may be greater than the second gate power voltage VGL. The first gate power voltage VGH may represent a high level of the gate signal G[n] and the second gate power voltage VGL may represent a low level of the gate signal G[n].

The gate signal G[n] having an amplitude greater than an amplitude of the gate primitive signal IN_On[n] may be generated by the level shifter.

Although, for example, the level shifter is disposed on the flexible circuit substrate 620 in the present embodiment, the level shifter may be disposed on the display panel 100 as shown in FIG. 3.

According to the present embodiment, the gate driver 300 and the data driver 500 are disposed at one side (e.g., upper side in FIG. 1) of the display panel 100 so that the bezel width of the side portion (e.g., left and right sides in the first direction DR1 in FIG. 1) of the display panel 100 may be reduced. The gate driver 300 and the data driver 500 are formed as the integral integrated circuit IIC so that the bezel width of the display apparatus may be reduced more effectively.

In addition, the level shifter of the gate signal may be formed on the flexible circuit substrate 620 so that the design constraints (i.e., the integral integrated circuit IIC cannot be located on the bezel area) of the integral integrated circuit IIC due to a structure having the reduced bezel width may be overcome.

In addition, in the gate driver 300 the gate signal may be generated by a decoding method so that the output sequence of the gate signal may be adjusted according to the input image data IMG. Thus, the power consumption may be reduced.

Figure 21:
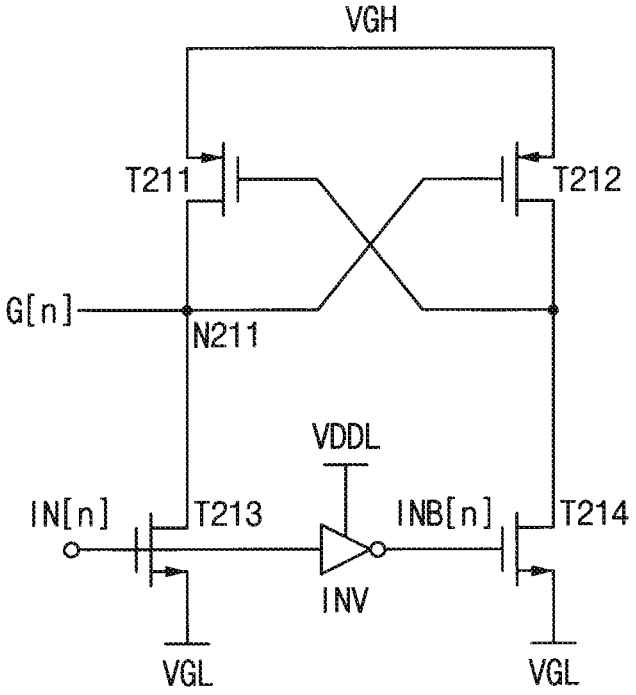
FIG. 21 is a circuit diagram illustrating a level shifter of a display apparatus according to still another embodiment of the present inventive concept.

FIG. 21 is a circuit diagram illustrating a level shifter of a display apparatus according to still another embodiment of the present inventive concept.

In the present embodiment, the level shifter of FIG. 19 may be replaced with the level shifter of FIG. 21 on the flexible circuit substrate 620. The level shifter of FIG. 21 includes first to fourth transistors T211 to T214 and an inverter INV. The first and second transistors T211 and T212 may be P-type transistors. The third and fourth transistors T213 and T214 may be N-type transistors. A gate primitive signal IN[n] may be applied to a control electrode of the third transistor T213. An inverted signal INB[n] of the gate primitive signal IN[n] may be applied to a control electrode of the fourth transistor T214. The gate signal G[n] may be outputted at output electrodes of the first and second transistors T211 and T212. A waveform of the gate primitive signal IN[n] may be the same as the waveform of the gate primitive signal IN_On[n] of FIG. 20. A waveform of the gate signal G[n] may be same as the waveform of the gate signal G[n] of FIG. 20.

Although, for example, the level shifter is disposed on the flexible circuit substrate 620 in the present embodiment, the level shifter may be disposed on the display panel 100 as shown in FIG. 3.

According to the present embodiment, the gate driver 300 and the data driver 500 are disposed at one side (e.g., upper side in FIG. 1) of the display panel 100 so that the bezel width of the side portion (e.g., left and right sides in the first direction DR1 in FIG. 1) of the display panel 100 may be reduced. The gate driver 300 and the data driver 500 are formed as the integral integrated circuit IIC so that the bezel width of the display apparatus may be reduced more effectively.

In addition, the level shifter of the gate signal may be formed on the flexible circuit substrate 620 so that the design constraints (i.e., the integral integrated circuit IIC cannot be located on the bezel area) of the integral integrated circuit IIC due to a structure having the reduced bezel width may be overcome.

In addition, in the gate driver 300 the gate signal may be generated by a decoding method so that the output sequence of the gate signal may be adjusted according to the input image data IMG. Thus, the power consumption may be reduced.

Figure 22:
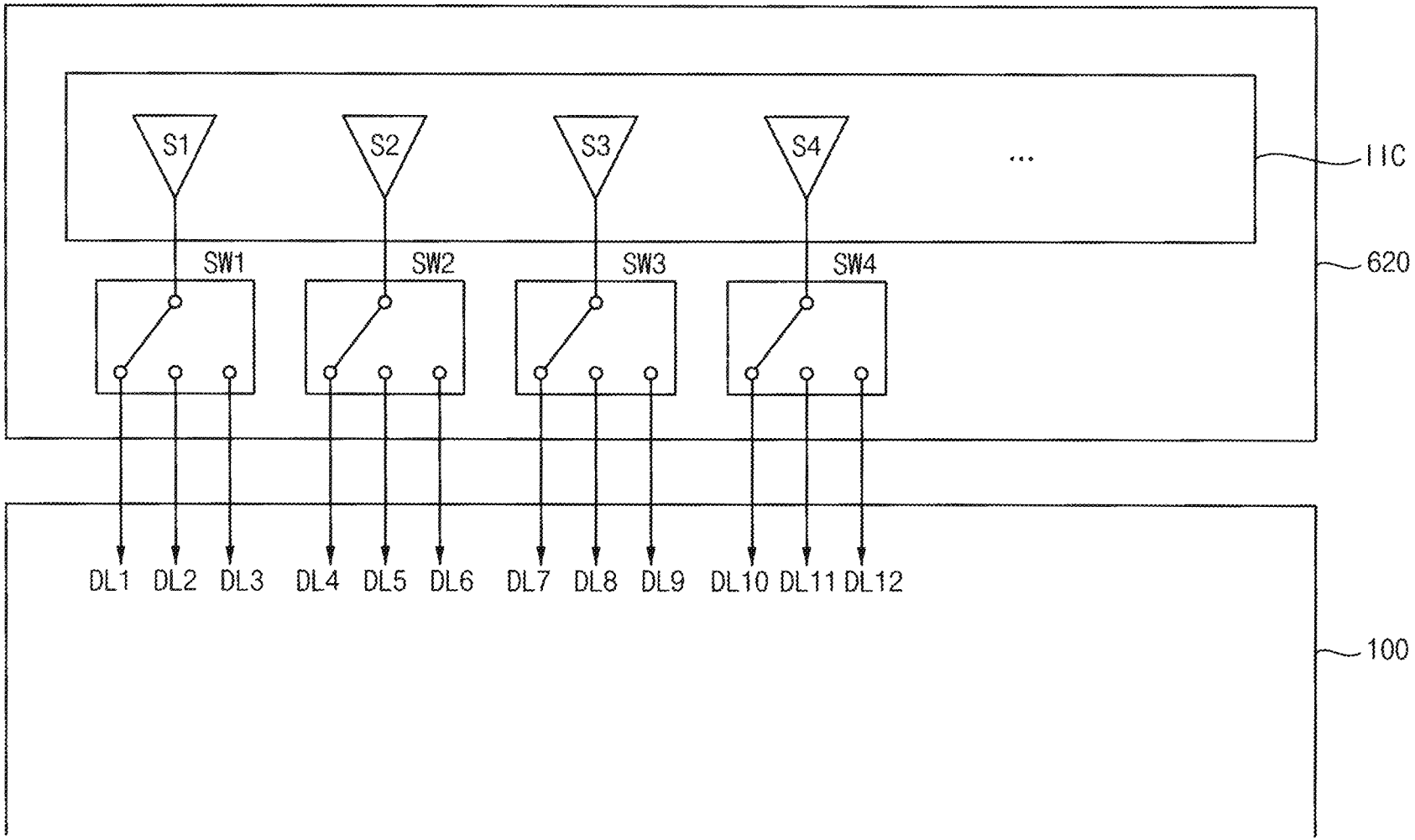
FIG. 22 is a plan view illustrating an example structure of a flexible circuit substrate, an integral integrated circuit and a display panel of a display apparatus according to still another embodiment of the present inventive concept.

FIG. 22 is a plan view illustrating an example structure of a flexible circuit substrate, an integral integrated circuit and a display panel of a display apparatus according to still another embodiment of the present inventive concept.

The display apparatus according to the present embodiment is substantially the same as the display apparatus of the previous embodiment explained referring to FIGS. 18 to 20 except that the flexible circuit substrate 620 further comprises source switches SW1, SW2, SW3 and SW4 connecting one data channel to one of data lines of the display panel 100 at a time. Although the gate channels are not illustrated in FIG. 22 for convenience of explanation, the integral integrated circuit IIC may include the gate channels like FIG. 18. In addition, the integral integrated circuit IIC of the present embodiment may further include readout channels like FIG. 4.

In the present embodiment, the source switches SW1, SW2, SW3 and SW4 are disposed on the flexible circuit substrate 620, not on the display panel 100 so that the bezel width of the display panel 100 may be further reduced.

According to the present embodiment, the gate driver 300 and the data driver 500 are disposed at one side (e.g., upper side in FIG. 1) of the display panel 100 so that the bezel width of the side portion (e.g., left and right sides in the first direction DR1 in FIG. 1) of the display panel 100 may be reduced. The gate driver 300 and the data driver 500 are formed as the integral integrated circuit IIC so that the bezel width of the display apparatus may be reduced more effectively.

In addition, the level shifter of the gate signal may be formed on the flexible circuit substrate 620 so that the design constraints (i.e., the integral integrated circuit IIC cannot be located on the bezel area) of the integral integrated circuit IIC due to a structure having the reduced bezel width may be overcome.

In addition, in the gate driver 300 the gate signal may be generated by a decoding method so that the output sequence of the gate signal may be adjusted according to the input image data IMG. Thus, the power consumption may be reduced.

Figure 23:
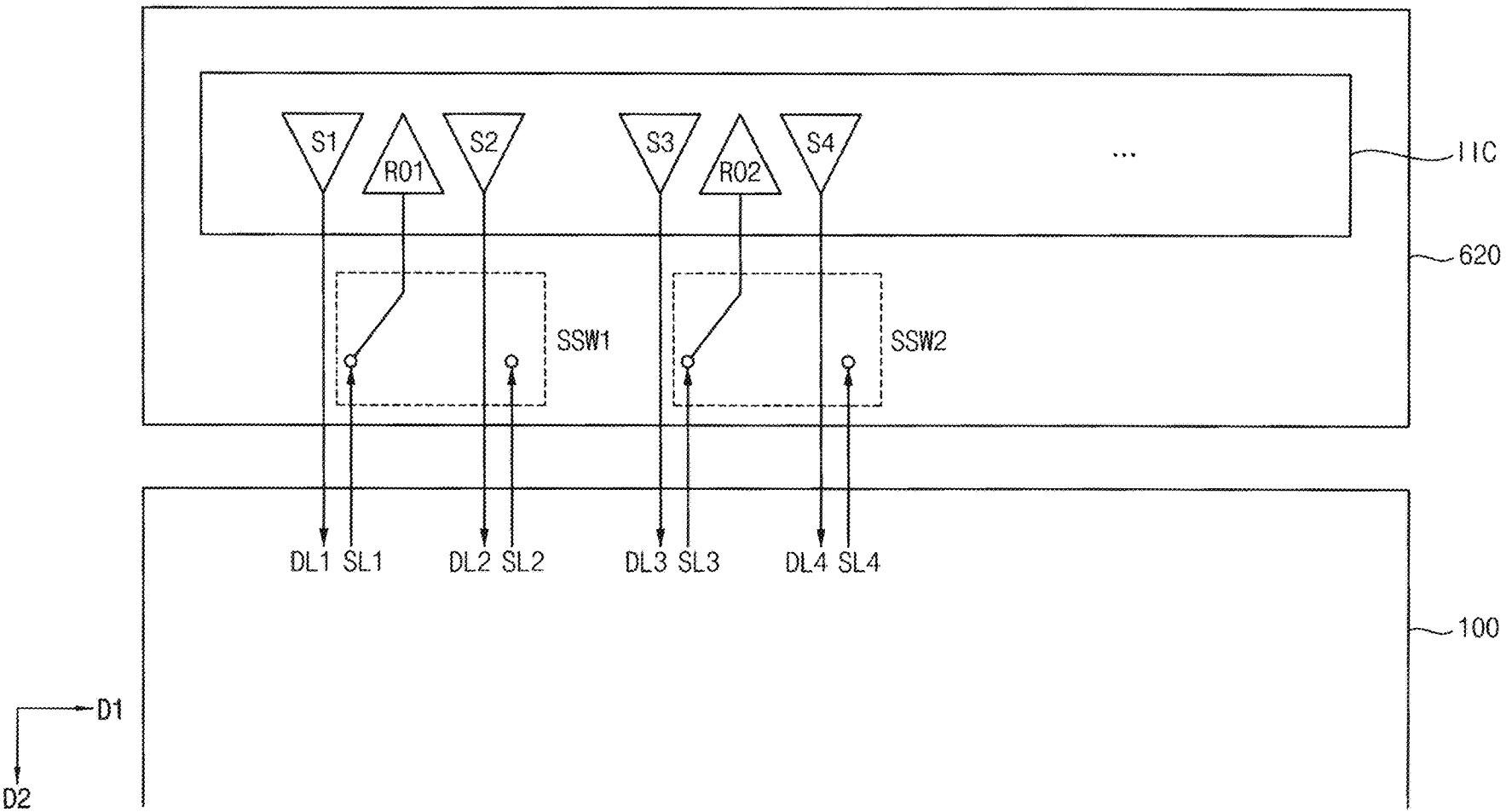
FIG. 23 is a plan view illustrating an example structure of a flexible circuit substrate, an integral integrated circuit and a display panel of a display apparatus according to yet another embodiment of the present inventive concept.

FIG. 23 is a plan view illustrating an example structure of a flexible circuit substrate, an integral integrated circuit and a display panel of a display apparatus according to yet another embodiment of the present inventive concept.

The display apparatus according to the present embodiment is substantially the same as the display apparatus of the previous embodiment explained referring to FIGS. 18 to 20 except that the display panel 100 includes a data line DL1, DL2, DL3 and DL4 extending in the second direction D2 and a sensing line SL1, SL2, SL3 and SL4 extending in the second direction D2, the integral integrated circuit IIC further includes a readout channel RO1 and RO2 receiving a sensing signal from the sensing line SL1, SL2, SL3 and SL4, and the flexible circuit substrate 620 further includes a sensing switch SSW1 and SSW2 selectively connecting one readout channel to one of the sensing lines. Although the gate channels are not illustrated in FIG. 23 for convenience of explanation, the integral integrated circuit IIC may include the gate channels like FIG. 18.

According to the present embodiment, the gate driver 300 and the data driver 500 are disposed at one side (e.g., upper side in FIG. 1) of the display panel 100 so that the bezel width of the side portion (e.g., left and right sides in the first direction DR1 in FIG. 1) of the display panel 100 may be reduced. The gate driver 300 and the data driver 500 are formed as the integral integrated circuit IIC so that the bezel width of the display apparatus may be reduced more effectively.

In addition, the level shifter of the gate signal may be formed on the flexible circuit substrate 620 so that the design constraints (i.e., the integral integrated circuit IIC cannot be located on the bezel area) of the integral integrated circuit IIC due to a structure having the reduced bezel width may be overcome.

In addition, in the gate driver 300 the gate signal may be generated by a decoding method so that the output sequence of the gate signal may be adjusted according to the input image data IMG. Thus, the power consumption may be reduced.

According to the display apparatus of the embodiments as explained above, the bezel width of the display apparatus may be reduced, the power consumption of the display apparatus may be reduced and the display quality of the display panel may be enhanced.

The foregoing is illustrative of the present inventive concept and is not to be construed as limiting thereof. Although a few embodiments of the present inventive concept have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein.

What is claimed is:

1. A display apparatus comprising:

an integral integrated circuit including a gate channel which outputs a gate primitive signal and a data channel which outputs a data voltage; and a display panel including a level shifter which amplifies the gate primitive signal to generate a gate signal, wherein the display panel is configured to display an image based on the gate signal and the data voltage, wherein the display panel includes a first gate line extending in a first direction and a second gate line extending in a second direction, the second direction is different from the first direction, and the second gate line is connected to the first gate line, and wherein the level shifter is connected to the second gate line.

2. The display apparatus of claim 1, wherein the display panel further includes a data line extending in the second direction.

3. The display apparatus of claim 1, wherein the gate channel is provided in plurality, and the integral integrated circuit further includes a decoder connected to the plurality of gate channels and which outputs the gate primitive signal to one of the gate channels.

4. The display apparatus of claim 1, wherein the display panel further includes a data line extending in the second direction and a sensing line extending in the second direction, and wherein the integral integrated circuit further includes a readout channel which receives a sensing signal from the sensing line.

5. The display apparatus of claim 4, wherein the integral integrated circuit includes a repeating channel group, and wherein the repeating channel group includes the data channel, the gate channel and the readout channel.

6. The display apparatus of claim 5, wherein the repeating channel group includes a first data channel, a first gate channel, a second data channel, a first readout channel and a third data channel which are sequentially disposed.

7. The display apparatus of claim 1, wherein when a pixel of the display panel includes an N-type transistor, the level shifter includes an N-type transistor.

8. The display apparatus of claim 7, wherein the display panel includes a first level shifter, a second level shifter, a third level shifter and a fourth level shifter which are sequentially disposed, wherein the first level shifter and the third level shifter are connected to a first clock line, and wherein the second level shifter and the fourth level shifter are connected to a second clock line.

9. The display apparatus of claim 8, wherein the first level shifter includes:

a first transistor including a control electrode which receives the gate primitive signal, an input electrode which receives the gate primitive signal and an output electrode connected to a first node;

a second transistor including a control electrode connected to the first node, an input electrode which receives a first gate power voltage and an output electrode connected to an output node;

a third transistor including a control electrode connected to the first clock line, an input electrode which receives the first gate power voltage and an output electrode connected to a second node;

a fourth transistor including a control electrode connected to the output node, an input electrode connected to the second node and an output electrode which receives a second gate power voltage;

a fifth transistor including a control electrode connected to the second node, an input electrode connected to the output node and an output electrode which receives the second gate power voltage; and a capacitor including a first electrode connected to the first node and a second electrode connected to the output node.

10. The display apparatus of claim 7, wherein the level shifter includes:

a first transistor including a control electrode which receives the gate primitive signal, an input electrode which receives the gate primitive signal and an output electrode connected to a first node;

a second transistor including a control electrode connected to the first node, an input electrode which receives a first gate power voltage and an output electrode connected to an output node;

a third transistor including a control electrode which receives a gate-off signal, an input electrode connected to the output node and an output electrode which receives a second gate power voltage; and a capacitor including a first electrode connected to the first node and a second electrode connected to the output node.

11. The display apparatus of claim 7, wherein the level shifter is provided in plurality, wherein an n-th level shifter is configured to receive an n-th gate primitive signal from an n-th gate channel, to receive an n+1-th gate signal from an n+1-th level shifter and to output an n-th gate signal, and wherein n is a positive integer.

12. The display apparatus of claim 11, wherein the n-th level shifter includes:

a first transistor including a control electrode which receives the n-th gate primitive signal, an input electrode which receives the n-th gate primitive signal and an output electrode connected to a first node;

a second transistor including a control electrode connected to the first node, an input electrode which receives a first gate power voltage and an output electrode connected to an output node;

a third transistor including a control electrode which receives the n+1-th gate signal, an input electrode connected to the output node and an output electrode which receives a second gate power voltage; and a capacitor including a first electrode connected to the first node and a second electrode connected to the output node.

13. The display apparatus of claim 1, wherein when a pixel of the display panel includes an N-type transistor and a P-type transistor, the level shifter includes an N-type transistor and a P-type transistor.

14. The display apparatus of claim 13, wherein the level shifter includes:

a first transistor including a control electrode which receives the gate primitive signal, an input electrode which receives a first gate power voltage and an output electrode connected to a first node;

a second transistor including a control electrode which receives the gate primitive signal, an input electrode connected to the first node and an output electrode which receives a second gate power voltage;

a third transistor including a control electrode connected to the first node, an input electrode which receives the first gate power voltage and an output electrode connected to an output node; and a fourth transistor including a control electrode connected to the first node, an input electrode connected to the output node and an output electrode which receives the second gate power voltage.

15. The display apparatus of claim 1, wherein the display panel further includes contact points connecting the first gate lines and the second gate lines, wherein the contact points form an atypical random pattern.

16. A display apparatus comprising:

an integral integrated circuit including a gate channel which outputs a gate primitive signal and a data channel which outputs a data voltage;

a flexible circuit substrate including a level shifter which amplifies the gate primitive signal to generate a gate signal; and a display panel connected to the flexible circuit substrate and which displays an image based on the gate signal and the data voltage, wherein the integral integrated circuit is disposed on the flexible circuit substrate, wherein the display panel includes a first gate line extending in a first direction, a second gate line extending in a second direction, the second direction is different from the first direction, and the second gate line is connected to the first gate line, and wherein the level shifter is connected to the second gate line.

17. The display apparatus of claim 16, wherein the level shifter includes:

a first transistor including a control electrode which receives a first gate power voltage, an input electrode which receives the first gate power voltage and an output electrode connected to a first node;

a second transistor including a control electrode connected to the first node, an input electrode which receives the first gate power voltage and an output electrode connected to an output node;

a third transistor including a control electrode which receives the gate primitive signal, an input electrode connected to the output node and an output electrode which receives a second gate power voltage; and a capacitor including a first electrode connected to the first node and a second electrode connected to the output node.

18. The display apparatus of claim 16, wherein the flexible circuit substrate further includes a source switch which selectively connects the data channel to one of a plurality of data lines of the display panel.

19. The display apparatus of claim 16, wherein the display panel further includes a data line extending in the second direction and a sensing line extending in the second direction, and wherein the integral integrated circuit further includes a readout channel which receives a sensing signal from the sensing line.

20. The display apparatus of claim 19, wherein the sensing line is provided in plurality, wherein the flexible circuit substrate further includes a sensing switch which selectively connects the readout channel to one of the plurality of sensing lines of the display panel.

* * * * *